US007457651B2

(12) United States Patent
Accatino et al.

(10) Patent No.: US 7,457,651 B2
(45) Date of Patent: Nov. 25, 2008

(54) DUAL MODE FILTER BASED ON SMOOTHED CONTOUR RESONATORS

(75) Inventors: Luciano Accatino, Turin (IT); Giorgio Bertin, Turin (IT)

(73) Assignees: Telecom Italia S.p.A., Milan (IT); Pirelli & C. S.p.A., Milan (IT)

( * ) Notice: Subject to any disclaimer, the term of this patent is extended or adjusted under 35 U.S.C. 154(b) by 62 days.

(21) Appl. No.: 10/573,891

(22) PCT Filed: Sep. 30, 2003

(86) PCT No.: PCT/EP03/10825

§ 371 (c)(1),
(2), (4) Date: Mar. 29, 2006

(87) PCT Pub. No.: WO2005/041345

PCT Pub. Date: May 6, 2005

(65) Prior Publication Data

US 2007/0035358 A1 Feb. 15, 2007

(51) Int. Cl.
*H01P 1/203* (2006.01)
*H01B 12/02* (2006.01)

(52) U.S. Cl. ..... 505/210; 333/204; 333/219; 333/99 S

(58) Field of Classification Search ..... 333/99 S, 333/204, 219; 505/210
See application file for complete search history.

(56) References Cited

U.S. PATENT DOCUMENTS 5,136,268 A 8/1992 Fiedziuszko et al.
5,172,084 A 12/1992 Fiedziuszko et al.
6,157,274 A 12/2000 Tada et al.
6,218,915 B1 * 4/2001 Schallner ..... 333/219
6,239,674 B1 5/2001 Enokihara et al.
6,360,112 B1 * 3/2002 Mizuno et al. ..... 505/210
6,630,875 B2 * 10/2003 Mizoguchi et al. ..... 333/204
2002/0130730 A1 * 9/2002 Abdelmonem et al. ..... 333/99 S

FOREIGN PATENT DOCUMENTS

EP 1 128 460 8/2001

OTHER PUBLICATIONS

Yabuki Hiroyuki, "Dual Mode Filter", Patent Abstracts of Japan, Publication No. 2000 209002, Publication Date of Jul. 28, 2000.

(Continued)

*Primary Examiner*—Benny Lee
(74) *Attorney, Agent, or Firm*—Finnegan, Henderson, Farabow, Garrett & Dunner, L.L.P.

(57) ABSTRACT

A planar filter has a planar resonator including a conductive region having smoothed contours and supporting a first resonating mode propagating along a first conductive path and a second resonating mode propagating along a second conductive path perpendicular to the first conductive path. The planar filter also has a conductor-free region made in the conductive region and having smoothed contours. The conductor-free region is disposed along a region axis forming an angle with respect to the first conductive path. The conductor-free region causes a perturbation of the symmetry of the planar resonator resulting in a frequency shift of the first and second resonating mode and their mutual coupling.

19 Claims, 7 Drawing Sheets

OTHER PUBLICATIONS

Makimoto Mitsuo, "Dual Mode Resonator", Patent Abstracts of Japan, Publication No. 09162610, Publication Date of Jun. 20, 1997.

Kaminami Seiji, "Dual Mode Band Pass Filter", Patent Abstracts of Japan, Publication No. 2001 320204, Publication Date of Nov. 16, 2001.

* cited by examiner

DUAL MODE FILTER BASED ON SMOOTHED CONTOUR RESONATORS

CROSS REFERENCE TO RELATED APPLICATION

This application is a national phase application based on PCT/EP2003/010825, filed Sep. 30, 2003, the content of which is incorporated herein by reference.

BACKGROUND OF THE INVENTION

1. Field of the Invention

The present invention generally relates to the field of communication systems. More particularly, the present invention relates to a dual mode planar filter for use in high-frequency signal processing devices used in communication systems.

2. Description of the Related Art

High frequency resonating filters are essential in the field of high-frequency communication systems. In particular, the field of mobile communication systems requires filters able to efficiently use the frequency band. Further, in base stations for mobile communications, filters having little loss, compact size and durability against a large electric power are desirable.

A wide variety of high-frequency resonating filters are known in the art.

For instance, in U.S. Pat. No. 5,136,268, a dual mode microstrip resonator usable in the design of microwave communication filters is disclosed. The substantially square resonator provides paths for a pair of orthogonal signals, which are coupled together using a perturbation located in at least one corner of the resonator. The perturbation can be introduced by notching the resonator or by adding a metallic or dielectric stub to the resonator.

The Applicant has observed that the above described filter can have problems due to the fact that electric current tends to concentrate at the corners of the resonator to considerably increase resistance loss therein. This can lead to a degradation of the Q-value of the resonator and therefore and increased loss in the filter.

In U.S. Pat. No. 5,172,084, planar dual mode filters are formed by a conductive resonator having circular symmetry and two pairs of symmetrically oriented planar conductive leads. The conductive leads are aligned colinearly with two orthogonal diameters of the circular conductive resonator. A perturbation located on a region axis oriented symmetrically with respect to the two pairs of conductive leads couples electromagnetic modes which are injected into the resonator by the planar conductive leads. Higher order filter circuits can be realized by combining multiple filters. The filters are amenable to printed circuit (microstrip or stripline) fabrication using superconductors for the conductive elements.

However, the Applicant has also observed that these type of filters can have problems due to the fact that an excessive concentration of electric current can occur at the edges of the perturbation, leading to a degradation of the Q-value of the resonator and increased loss in the filter.

In U.S. Pat. No. 6,239,674, a resonator having high Q-value is disclosed. The resonator has a compact structure with little loss caused by the conductor's resistance. The conductor of elliptical shape forming the resonator has two points along its circumference at which both of the two orthogonal resonating modes of the resonator are excited equally.

SUMMARY OF THE INVENTION

The Applicant has observed that in these types of filters it is rather complicated obtaining the coupling between the two resonating modes. In fact, as disclosed above, this coupling is obtained only bonding the input/output terminals of the filter at appropriate points along the conductor circumference.

The Applicant faced the problem of realizing a planar filter in which the coupling between the resonating modes can be easily obtained thereby maintaining high Q-values and low loss.

In particular, the Applicant has found that this problem can be solved by realizing a planar filter comprising a planar resonator including a conductive region having smoothed contours and supporting a first resonating mode propagating along a first conductive path and a second resonating mode propagating along a second conductive path, perpendicular to the first conductive path. The planar filter also comprises a conductor-free region made in the conductive region and having smoothed contours. The conductor-free region is disposed along a region axis forming an angle θ with respect to the first conductive path. The conductor-free region causes a perturbation of the symmetry of the planar resonator resulting in a frequency shift of the first and the second resonating mode and their mutual coupling.

According to an aspect of the present invention, there is provided a planar filter comprising:

- a planar resonator including a conductive region supporting a first resonating mode propagating along a first conductive path, the conductive region being smoothed contour shaped region; and
- a conductor-free region made in the conductive region;

wherein the conductor-free region is a smoothed contour shaped region symmetrically disposed along a region axis forming an angle θ with respect to the first conductive path.

According to a further aspect of the present invention, there is provided a receiver front-end for use in a transceiver station of a wireless communication network, the receiver front-end comprising:

- a first node coupled to a transceiver antenna;
- a second node coupled to signal processing sections of said transceiver station; and
- a receiving branch inserted between said first and second nodes, the receiving branch comprising a cryostat enclosing a low noise amplifier;

wherein said cryostat encloses a planar filter made according to the present invention, the planar filter being mutually connected in cascade arrangement to said low noise amplifier.

Further preferred aspects of the present invention are described in the dependent claims and in the following description.

BRIEF DESCRIPTION OF THE DRAWINGS

The features and advantages of the present invention will be made apparent by the following detailed description of some embodiments thereof, provided merely by way of non-limitative examples, which will be made referring to the attached drawings, wherein.

DETAILED DESCRIPTION OF THE INVENTION

Figure 1:
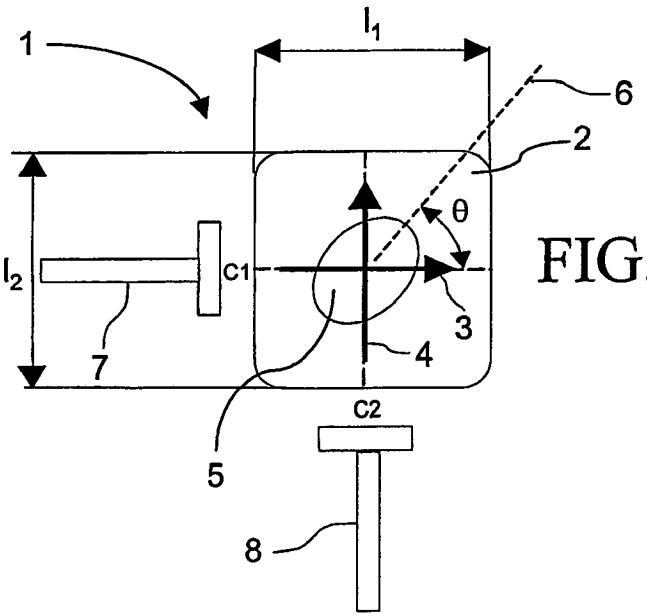
FIG. 1 is a top view of a first embodiment of a dual mode planar resonator according to the present invention.

FIG. 1 shows a dual mode planar resonator 1 comprised in a dual mode planar filter and including a conductive region 2 having smoothed contours and supporting two orthogonal resonating modes at desired frequencies.

In a first embodiment of the present invention, the conductive region 2 has a polygonal shape with edges significantly rounded. Preferably, the polygonal shape is a square shape or a rectangular shape.

In the remainder of the present description and claims we shall define as "edge significantly rounded" an edge having for example a bending radius in the range of about 10% to 30% of the mean value of the polygon side lengths.

In an embodiment of the present invention shown in FIG. 1, the conductive region 2 has a substantially rectangular shape with side lengths $l_1$, $l_2$. In the conductive region 2 resonance of a first resonating mode occurs when side length $l_1$ is about half wavelength at the operating frequency. Similarly, resonance of a second resonating mode, orthogonal to the first resonating mode, occurs when side length $l_2$ is about half wavelength at the operating frequency.

Always with reference to FIG. 1, a first vector 3 is indicative of a first conductive path along which the first resonating mode propagates. Similarly, a second vector 4, perpendicular to the first vector 3, is indicative of a second conductive path along which the second resonating mode propagates.

The dual mode planar resonator 1 also comprises a conductor-free region 5 made in the conductive region 2 and having smoothed contours. Specifically the conductor-free region 5 is symmetrically disposed along a region axis 6 forming an angle θ with respect to the orientation of vector 3.

Preferably, the conductor-free region 5 is an elliptical shape region having its major axis parallel to the region axis 6.

The conductor-free region 5 causes a perturbation of the symmetry of the dual mode planar resonator 1 resulting in a frequency shift of both orthogonal resonating modes represented by vectors 3, 4 and their mutual coupling.

Specifically, the tuning of the two orthogonal resonating modes and the control of their coupling can be easily achieved by varying the angle θ.

Figure 2:
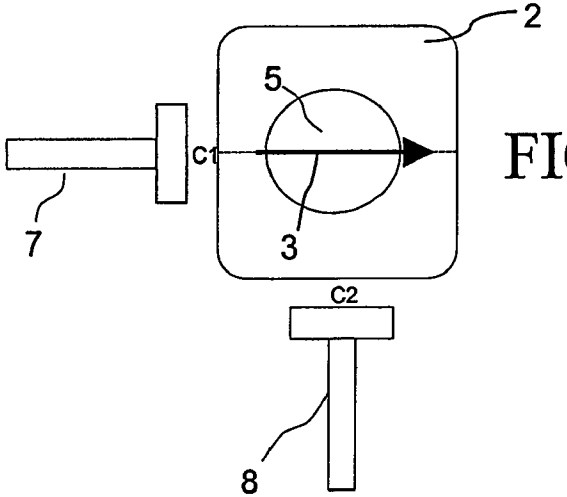
FIG. 2 is a top view of a single mode planar resonator made according to the present invention.

In particular, at $\theta=0°\pm\pi/2$ no coupling is observed between the two orthogonal resonating modes. In this condition, the tuning of each resonating mode can be obtained independently, by varying the conductor-free region diameters ratio Dmax/Dmin. In both cases the planar resonator 1 operates as a single mode planar resonator. As shown in FIG. 2, in this case the conductor-free region 5 can be a circular shaped region. Reference symbols used in FIG. 2 are otherwise consistent with those used in FIG. 1 and will not be re-described.

When $\theta=45°\pm\pi/2$ the conductor-free region 5 provides the maximum level of coupling between the two orthogonal resonating modes but, if the conductive region 2 is symmetric ($l_1=l_2$), for symmetric reasons the same level of detuning take place for both the modes. In this case the planar resonator 1 operates as a dual mode planar resonator with the maximum level of coupling.

However, selectively tuning the two orthogonal resonating modes is possible by varying the aspect ratio of the conductive region 2. In particular, the resonating mode represented by vector 3 can be tuned by varying the side length $l_1$ of the conductive region 2, while the resonating mode represented by vector 4 can be tuned by varying the side length $l_2$ of the conductive region 2.

Further, keeping the angular position θ fixed at $45°\pm\pi/2$ the coupling between the two orthogonal resonating modes can be finely adjusted by varying the conductor-free region diameters ratio Dmax/Dmin. The limit case of Dmax/Dmin=1 corresponds to the case of no coupling already discussed.

Therefore, according to the present invention, when $\theta=45°\pm\pi/2$ a fine tuning of the two resonating modes and a fine adjustment of the degree of their coupling can be achieved independently and in an easy manner.

Again with reference to FIG. 1, the dual mode planar resonator 1 further comprises at least a pair of planar conductive leads 7, 8 capacitively coupled to the dual mode planar resonator 1 through gaps C1-C2 respectively. Capacitive coupling coefficients between the planar conductive leads 7, 8 and the dual mode planar resonator 1 can be adjusted by varying the size and shape of gaps C1-C2 or the shape of the termination of conductive leads 7, 8. Alternatively, capacitive coupling can be achieved by using optional capacitive parts (such as a capacitor) to connect the planar conductive leads 7, 8 to the dual mode planar resonator 1.

Figure 3:
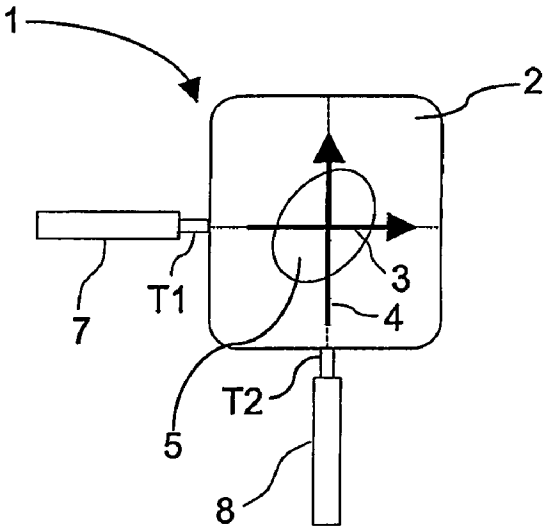
FIG. 3 is a top view of the dual mode planar resonator of FIG. 1 made with an inductive coupling.

Referring now to FIG. 3, in a different aspect of the present invention, the planar conductive leads 7, 8 can be inductively coupled to the dual mode planar resonator 1 through taps T1-T2 respectively. Alternatively, inductive coupling can be achieved by using optional inductive parts (such as a coil or a wire bond) or by using a fine lead line of a proper length to connect directly the planar conductive leads 7, 8 to the dual mode planar resonator 1.

Planar conductive lead 7 can act as input terminal of the dual mode planar resonator 1 while planar conductive lead a can act as output terminal. In this condition, high frequency signals are coupled into the dual mode planar resonator 1 from planar conductive lead 7 though gap C1 (FIG. 1) or tap T1 (FIG. 3). Similarly, high frequency signals are coupled out of the dual mode planar resonator 1 to the planar conductive lead 8 though gap C2 (FIG. 1) or tap T2 (FIG. 3). Alternatively, planar conductive lead a can act as input terminal of the dual mode planar resonator 1 while planar conductive lead 7 can act as output terminal.

With reference to FIGS. 1, 2 and 3 in operation, a high frequency signal entering dual mode planar resonator 1 though planar conductive lead 7 and gap C1 (FIG. 1), or tap T1 (FIG. 3), introduces a first mode resonating along vector 3 (FIG. 1).

Conductor-free region 5 causes a perturbation of the current flow resulting in a coupling to the mode resonating along vector 4 (FIG. 1). Planar conductive lead 8 is used to extract the coupled high frequency signal from the dual mode planar resonator 1.

Figure 4:
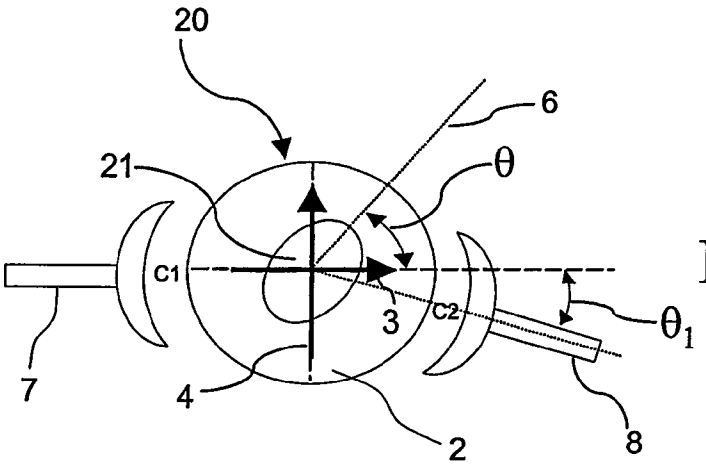
FIG. 4 is a top view of a second embodiment of the dual mode planar resonator of FIG. 1.

As shown in FIG. 4, a dual mode planar resonator 20 according to the present invention comprises a conductive region 21 having preferably an elliptical shape; the major and minor diameters of said elliptical conductive region being dimensioned to support two orthogonal resonating modes at a desired frequency.

The other parts of the dual mode planar resonator 20 are the same as those described with reference to the dual mode planar resonator 1 of FIGS. 1, 2 and 3 and therefore they will not be described again.

As shown in FIG. 4, in this case, a high degree of input/output coupling can be achieved by widening the end of the conductive leads 7, 8 and/or by varying the angular position $\theta_1$ of the planar conductive lead 8 with respect to the orientation of the vector 3. In fact, if the planar conductive lead 8 is positioned at an angle $\theta_1$ with respect to the orientation of the vector 3, the coupled high frequency signal extracted from the dual mode planar resonator 20 is a linear combination of the two orthogonal resonating modes 3, 4. This degree of freedom is useful for obtaining more complex filter transfer functions.

Advantageously, in both the embodiments of the present invention, the conductive region 2, 21 can be made by a high-temperature oxide superconductor represented by: a yttrium (Y) family superconductor such as $YBa_2CU_3O_x$ or the like; a bismuth (Bi) family superconductor such as $Bi_2Sr_2Ca_2Cu_3O_x$ or the like; a thallium (Tl) family superconductor such as $Tl_2Ba_2CaCu_2O_x$ or the like; a metallic superconductor such as Nb or the like. Less preferably, by an ordinary conductor such as gold, copper, etc.

It should be noted that in general, using a superconductor as the conductor material of a resonator provides a considerable decrease in conductor loss which increases the resonator's Q-value drastically. However, a current density exceeding the value of the superconductor material's critical current density cannot be applied. This becomes a problem in the case of handling high frequency signals having high power. As mentioned before, since the dual mode planar resonator 1 of the present invention has a structure preventing peak current density, by using a superconductor material for the conductive region 2, 21, a high frequency signal of a larger power can be used as compared with dual mode resonating filters having conventional structures. Consequently, a dual mode planar resonator having a high power handling capability is obtained.

Figure 5:
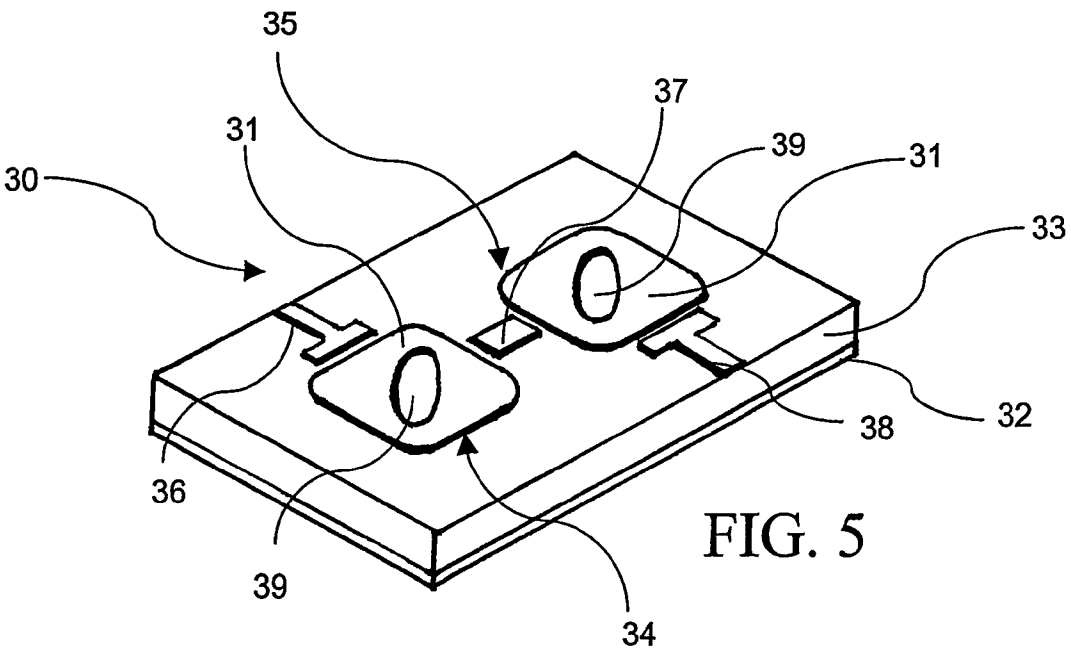
FIG. 5 is a prospective view of a four pole planar filter according to the present invention.

In FIG. 5 there is illustrated a prospective view of a four pole planar filter 30 based on microstrip technology and utilizing two dual mode planar resonators made according to the present invention. Alternatively, the four pole planar filter 30 can be based on a stripline technology.

Specifically, at a frequency of about 2 GHz, with a dielectric slab having a dielectric constant of about 24 and a thickness of about 0.5 mm, each planar resonator 34, 35 can have side lengths $l_1$, $l_2$ in the range of about 10 to 15 mm.

Preferably, the first conductive layer 31 is made by a high-temperature oxide superconductor of the type described above with reference to the conductive region 2, 21. In this case, the dielectric slab 33 can be preferably made by dielectric materials such as Lanthanum Aluminate ($LaAlO_3$) having a dielectric constant $\in_r$ of about 24, Magnesium Oxide (MgO) having a dielectric constant $\in_r$ of about 10, etc.

First and second dual mode planar resonators 34, 35 and planar conductive leads 36, 37, 38 are generated on the top of the dielectric slab 33 by etching the first conductive layer 31. The second conductive layer 32 on the bottom of the dielectric slab 33 serves as a ground plane.

Planar conductive leads 36, 37, 38 are capacitively coupled to the dual mode planar resonators 34, 35.

Specifically, at a frequency of about 2 GHz, with a dielectric slab having a dielectric constant of about 24 and a thickness of about 0.5 mm, each planar resonator 34, 35 can have side lengths $l_1$, $l_2$ in the range of about 10 to 15 mm.

In operation, the planar conductive lead 36 provides energy from a high frequency signal to the first dual mode planar resonator 34 where a respective conductive-free region 39 couples some of this energy into an orthogonal mode. Energy is coupled out of the first dual mode planar resonator 34 and into the second dual mode planar resonator 35 by means of the planar conductive lead 37. Additional second order filtering is introduced in the second dual mode planar resonator 35.The output high frequency signal of this four pole planar filter 30 is extracted through the planar conductive lead 38.

Figure 6:
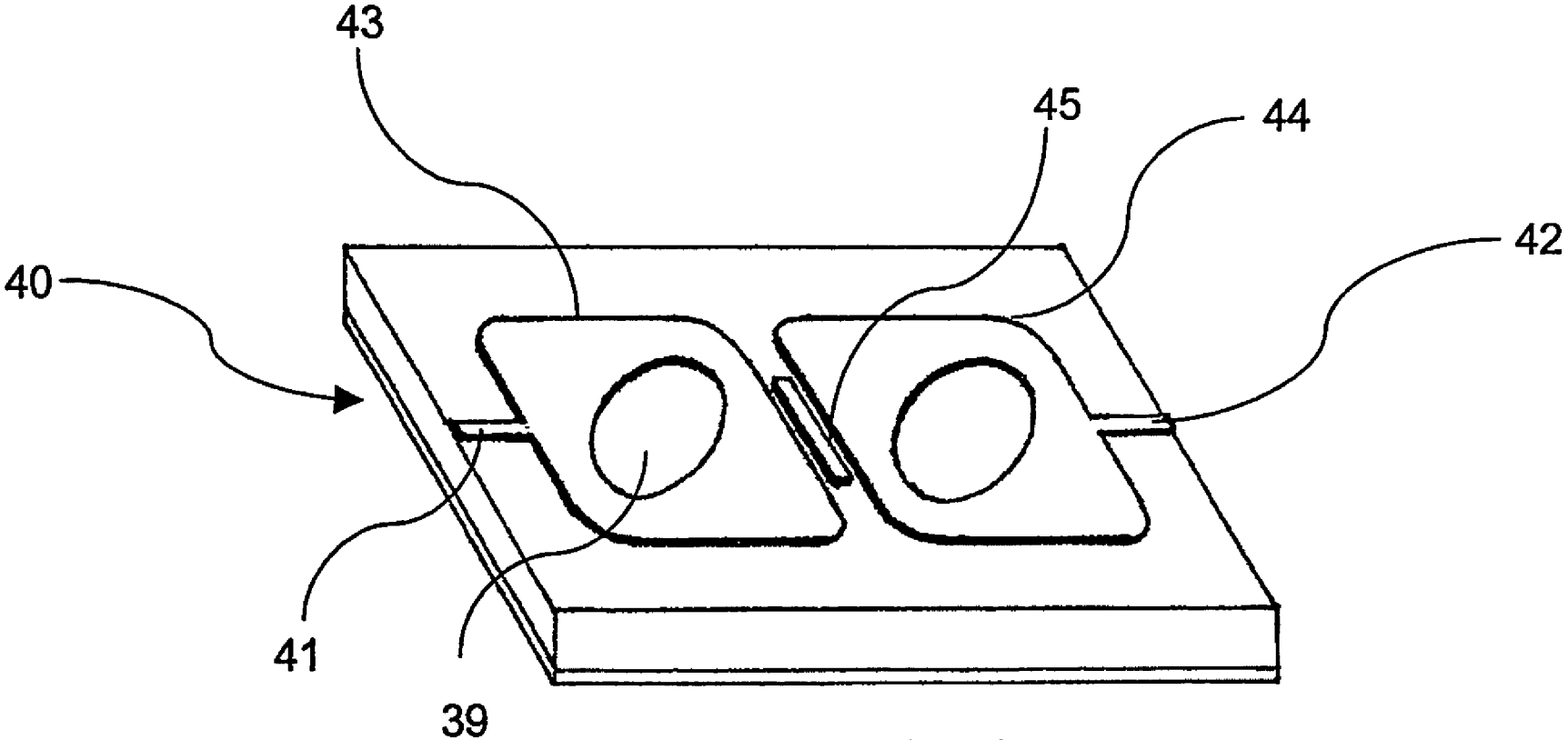
FIG. 6 is a prospective view of another four pole planar filter according to the present invention.

In FIG. 6 there is illustrated a prospective view of a four pole planar filter 40 according to the present invention. The four pole planar filter 40 comprises planar conductive leads 41, 42 inductively coupled to respectively first and second dual mode planar resonators 43, 44 made according to the present invention. The four pole planar filter 40 also comprises a planar conductive lead 45 capacitively coupled to both the first and the second dual mode planar resonator 43, 44.

The other parts of the four pole planar filter are the same as those described with reference to FIG. 5 and therefore they will not be described again.

In operation, the planar conductive lead 41 couples inductively input energy to the first dual mode planar resonator 43 where a respective conductive-free region 39 couples some of this energy into an orthogonal mode. This orthogonal mode is capacitively coupled out of the first dual mode planar resonator 43 and into the second dual mode planar resonator 44 by means of the planar conductive lead 45. Additional second order filtering is introduced in the second dual mode planar resonator 44. The output high frequency signal of this four pole planar filter 40 is inductively extracted through the planar conductive lead 42.

Advantageously, a refinement tuning of the coupling between the two dual mode planar resonators 43, 44 can be obtained by varying the length of the planar conductive lead 45.

Figure 7:
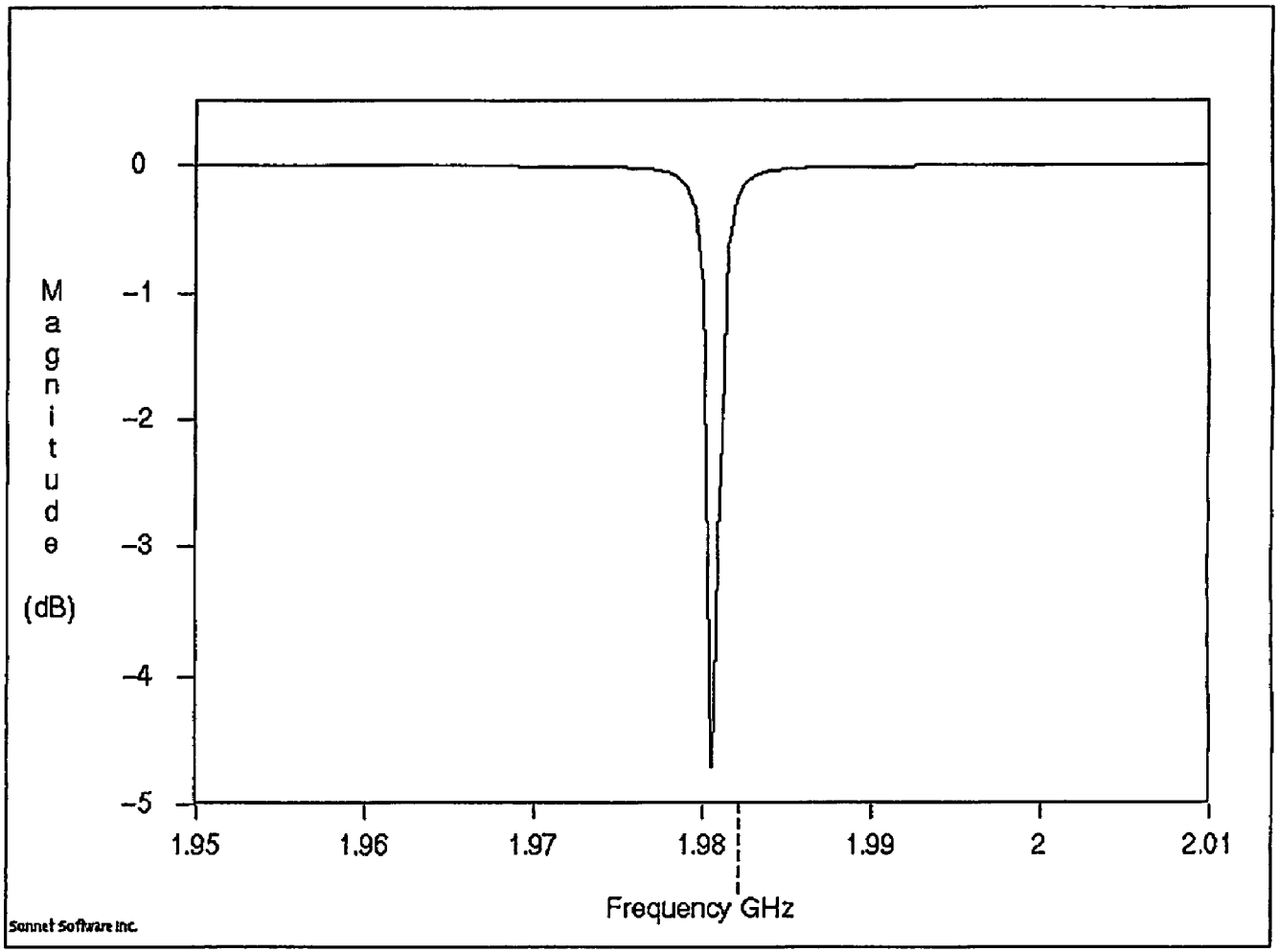
FIG. 7 is a graph showing a reflection characteristic of the single mode planar resonator of FIG. 2.
Figure 8:
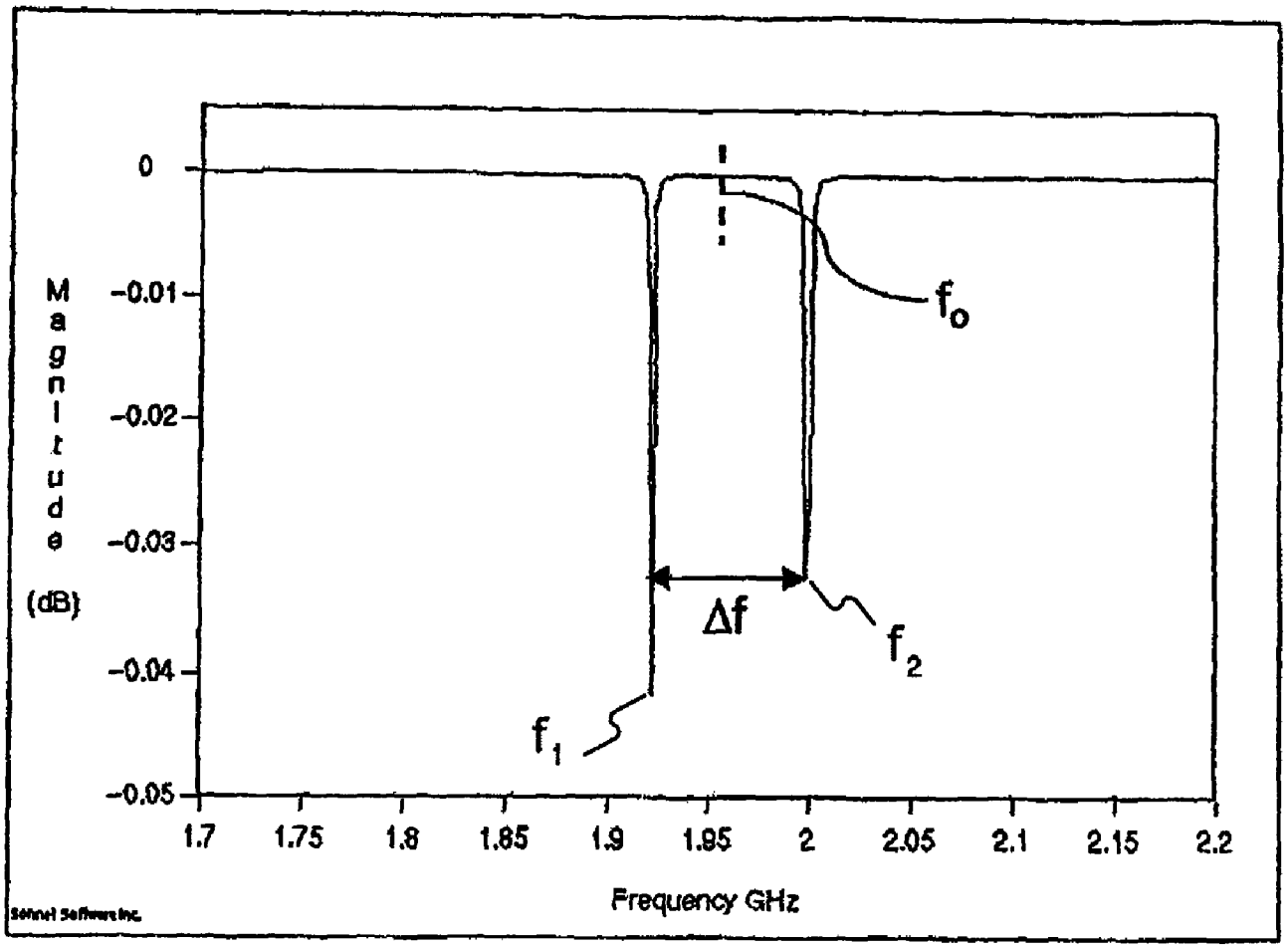
FIG. 8 is a graph showing a reflection characteristic of the dual mode planar resonator of FIG. 1.

With reference to FIGS. 7 and 8, the Applicant has simulated (using "Sonnet" commercial software) the dual mode planar resonator 1 according to the first embodiment of the present invention.

Specifically, FIG. 7 shows the reflection characteristic with respect to the frequency of the dual mode planar resonator 1 operating in single-mode. The reflection characteristic was measured at the planar conductive lead 7 using a capacitive coupling between the planar conductive lead 7 and the planar resonator 1. The conductor-free region 5 was an elliptical shape region centred at the intersection of the two vectors 3, 4 and having its major axis parallel to the vector 3 ($\theta=0°$ or $\theta=90°$). As disclosed above, in this case no coupling is observed between the two orthogonal resonating modes. According to this the reflection characteristic has only one resonance peak that, in this case, is at a frequency of ≈1.98 GHz with a magnitude of ≈−4.8 dB.

FIG. 8 shows the reflection characteristic with respect to the frequency of the dual mode planar resonator 1 operating in dual mode. The reflection characteristic was measured at the planar conductive lead 7 using a capacitive coupling between the planar conductive lead 7 and the planar resonator 1. The conductor-free region 5 was an elliptical shape region centred at the intersection of the two vectors 3, 4 and having its major axis forming an angle $\theta=45°$ with respect to the vector 3. As disclosed above, in this case the maximum level of coupling between the two orthogonal resonating modes is observed. According to this the reflection characteristic has two resonance peaks that in this case are at a frequency $f_1 \approx 1.922$ GHz with a magnitude of ≈−0.0455 dB and at a frequency $f_2 \approx 1.998$ with a magnitude of ≈−0.035 dB. The coupling coefficient k between the two resonating modes is represented by the following expression:

$$k = \frac{\Delta f}{f_0}$$

where Δf is the distance between the two resonance peaks and $f_0$ is their mean value. For the dual mode planar resonator having the reflection characteristic of FIG. 8 the coupling coefficient k is equal to 0.0389.

Further, it should be noted from FIGS. 7 and 8 that the dual mode planar resonator of the present invention has a relatively high Q-value.

In addition the dual mode planar resonator according to the present invention has small size and low mass.

Figure 9:
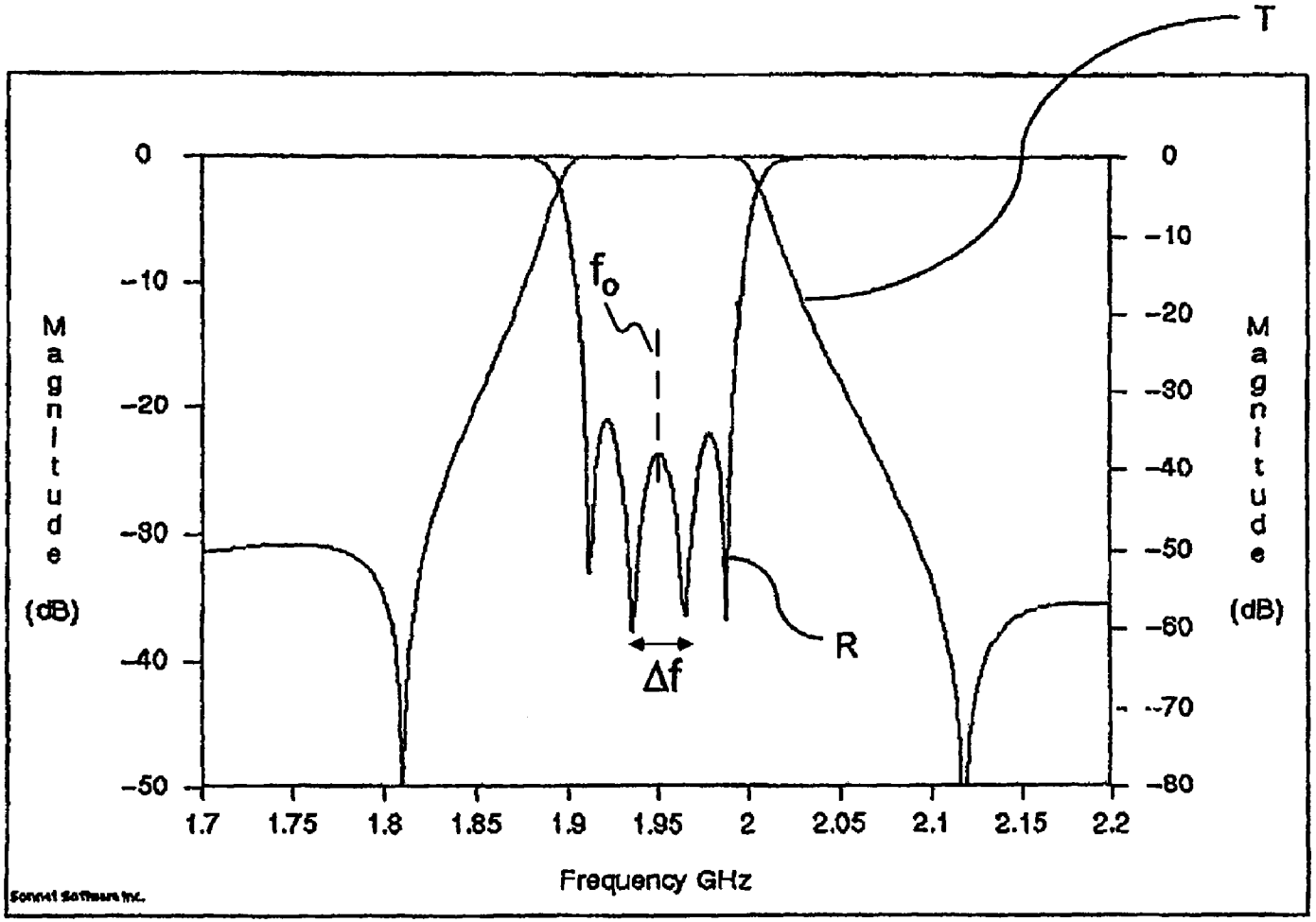
FIG. 9 is a graph showing the frequency response of the four pole planar filter of FIG. 6.

Referring now to FIG. 9, the Applicant has simulated (using "Sonnet" commercial software) the operation of the four pole planar filter 40 shown in FIG. 6.

In particular, FIG. 9 shows the transmission curve T and the reflection curve R of the our pole planar filter 40 of FIG. 6 measured when both the elliptical shape regions of the dual mode planar resonators 43, 44 have an angular position θ=45° providing the maximum level of coupling between the two orthogonal resonating modes.

As shown in FIG. 9, the four pole planar filter 40 has a bandwidth Δf of about 76 MHz centred at $f_0$≈1.950 GHz.

Specifically, the transmission curve T has two zeros at 1.810 GHz and 2.118 GHz due to an extra coupling between a mode resonating in the dual mode planar resonator 43 along a direction parallel to conductive lead 41 and a mode resonating in the dual mode planar resonator 44 along a direction orthogonal to conductive lead 42 with respect to FIG. 6.

The simulated in-band return loss is better than 24 dB.

Small size and low mass make the dual mode planar filter of the present invention suitable for example for use in transceiver station receiver front-ends.

Figure 10:
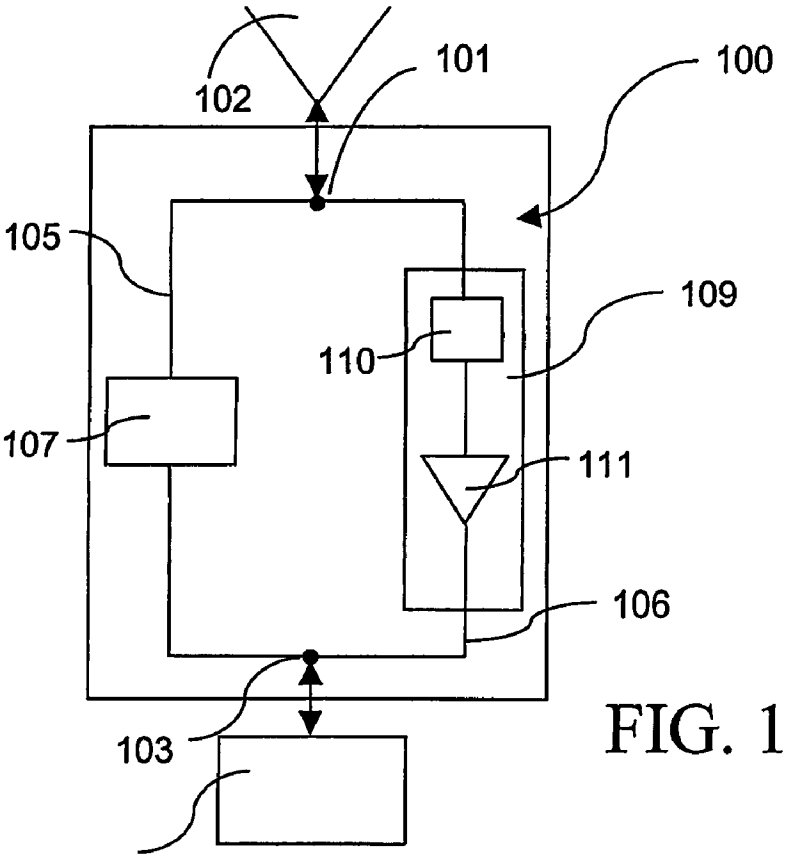
FIG. 10 is a schematic representation of a receiver front-end using the dual mode planar filter of the present invention.

According to this, FIG. 10 illustrates a schematic representation of a receiver front-end 100 for use in a transceiver station of a wireless communication network. The receiver front-end 100 comprises a dual mode planar filter, made according to the present invention.

In detail, the receiver front-end 100 comprises a first node 101 adapted for coupling a transceiver antenna 102 and a second node 103 adapted for coupling to signal processing sections 104 of the transceiver station. Between the first and the second node 101, 103 there are inserted a transmitting branch 105 and a receiving branch 106. The transmitting branch 105 comprises a transmitting filter 107 while the receiving branch 106 comprises a cryostat 109 enclosing a dual mode planar filter 110, made according to the present invention, and a low noise amplifier (LNA) 111, mutually connected in cascade arrangement.

Preferably, the transmitting filter 107 can also be made according to the present invention.

In operation, the radio signal received by the transceiver antenna 102 is sent to the first node 101. In the first node 101 the radio signal is addressed to the receiving branch 106. In the cryostat 109 the radio signal is filtered by the dual mode planar filter 110 and then amplified by the low-noise amplifier 111. The resulting radio signal is then sent to the signal processing sections 104.

The transmitting branch 105 is used for the RF communication between the transceiver station and a plurality of communication devices located in a cell supervised by the transceiver station.

Finally, it is clear that numerous variations and modifications may be made to the receiver front-end described and illustrated herein, all falling within the scope of the invention, as defined in the attached claims.

The invention claimed is:

1. A planar filter comprising a planar resonator including:

a conductive region supporting a first resonating mode propagating along a first conductive path, said conductive region being a smoothed contour shaped region; and a conductor-free region disposed in said conductive region, said conductor-free region being a smoothed contour shaped region symmetrically disposed along a region axis, the region axis having an angle θ with respect to said first conductive path, and the angle θ being an odd multiple of 45°.

2. The planar filter according to claim 1, wherein said conductor-free region is disposed internally to said conductive region.

3. The planar filter according to claim 1, comprising a second resonating mode propagating along a second conductive path, said second resonating mode being perpendicular to said first resonating mode, and said conductor-free region causing a perturbation of the symmetry of said planar resonator resulting in a frequency shift of said resonating modes and their mutual coupling.

4. The planar filter according to claim 3, wherein said conductor-free region is disposed internally to said conductive region.

5. The planar filter according to claim 1, wherein said conductive region has a polygonal shape with edges significantly rounded.

6. The planar filter according to claim 5, wherein each of said edges significantly rounded has a bending radius of about 10% to 30% of the mean value of the polygon side lengths.

7. The planar filter according to claim 1, wherein said conductive region has an elliptical shape.

8. The planar filter according to claim 1, wherein said conductor-free region is an elliptical shaped region having the major axis parallel to said region axis.

9. The planar filter according to claim 1, comprising a dual mode planar resonator and at least a pair of planar conductive leads for coupling high frequency signals into and out of said dual mode planar resonator.

10. The planar filter according to claim 9, wherein said at least a pair of planar conductive leads is capacitively coupled to said dual mode planar resonator through respective gaps.

11. The planar filter according to claim 9, wherein said at least a pair of planar conductive leads is inductively coupled to said dual mode planar resonator through respective taps.

12. The planar filter according to claim 1, wherein the conductive region is a superconductor material.

13. The planar filter according to claim 12, wherein said superconductor material is a high-temperature oxide superconductor.

14. The planar filter according to claim 13, wherein said high-temperature oxide superconductor is represented by an yttrium family superconductor.

15. The planar filter according to claim 13, wherein said high-temperature oxide superconductor is represented by a bismuth family superconductor.

16. The planar filter according to claim 13, wherein said high-temperature oxide superconductor is represented by a thallium family superconductor.

17. The planar filter according to claim 12, wherein said superconductor material comprises a metallic superconductor.

18. A receiver front-end for use in a transceiver station of a wireless communication network, said receiver front-end comprising:

a first node coupled to a transceiver antenna;

a second node coupled to signal processing sections of said transceiver station; and a receiving branch inserted between said first and second nodes, said receiving branch comprising a cryostat enclosing a low noise amplifier, said cryostat enclosing a planar filter according to claim 1, and mutually connected in cascade arrangement to said low noise amplifier.

19. A receiver front-end for use in a transceiver station of a wireless communication network, said receiver front-end comprising:

a first node coupled to a transceiver antenna;

a second node coupled to signal processing sections of said transceiver station;

a receiving branch inserted between said first and second nodes, said receiving branch comprising a cryostat enclosing a low noise amplifier, said cryostat enclosing a planar filter according to claim 1, said planar filter being mutually connected in cascade arrangement to said low noise amplifier; and a transmitting branch inserted between said first and second nodes, said transmitting branch comprising a transmitting filter.

* * * * *